US005282882A

United States Patent [19]

Galvin et al.

[11] Patent Number: 5,282,882

[45] Date of Patent: Feb. 1, 1994

[54] PROCESS FOR REFINING CRUDE MAGNESIUM

[75] Inventors: Paul-Henri Galvin, Le Fayet; Jean-Pierre Bessaguet, Sallanches, both of France

[73] Assignee: Pechiney Electrometallurgie, Courbevoie, France

[21] Appl. No.: 6,970

[22] Filed: Jan. 21, 1993

[30] Foreign Application Priority Data

Jan. 23, 1992 [FR] France ..... 92 00911

[51] Int. Cl.[5] ..... C22B 26/22

[52] U.S. Cl. ..... 75/601; 75/604

[58] Field of Search ..... 75/600, 601, 602, 603, 75/604, 594

[56] References Cited

U.S. PATENT DOCUMENTS 4,390,364 6/1983 Yu ..... 75/601
4,417,920 11/1983 Mena et al. .

FOREIGN PATENT DOCUMENTS 139432 6/1934 Austria .
1031975 11/1958 Fed. Rep. of Germany .
1110998 2/1956 France .
2516940 5/1983 France .
201742 9/1986 Japan ..... 75/601
433859 8/1935 United Kingdom ..... 75/604
548880 4/1941 United Kingdom .

*Primary Examiner*—Melvyn J. Andrews
*Attorney, Agent, or Firm*—Dennison, Meserole, Pollack & Scheiner

[57] ABSTRACT

The invention relates to a process for refining crude magnesium, and, in particular, the magnesium obtained by reducing the magnesium ore using iron-silicon.

The process consists in treating the liquid magnesium with a metallic sulphide such as iron monosulphide, iron bisulphide or molybdenum bisulphide.

The sulphides are contacted with the metallic bath which is agitated to promote the liquid-solid reactions and the formation of insoluble products which precipitate.

This contacting is followed by decantation of the insoluble products and their separation from the refined magnesium.

The process permits a significant reduction in the contents of calcium and silicon.

7 Claims, No Drawings

PROCESS FOR REFINING CRUDE MAGNESIUM

DOMAIN OF THE INVENTION

The invention relates to a process for refining crude magnesium which in particular makes it possible for two elements, calcium and silicon, present in the crude magnesium to be removed.

DESCRIPTION OF THE PRIOR ART

Magnesium can be purified of its impurities, which may be metallic or otherwise, by treating the liquid metal with chloride based fluxes which are added to the metal bath and which are stirred vigorously.

Various types of fluxes can be used:

magnesium chloride based fluxes or fluxes with a base of magnesium chloride and potassium chloride mixtures. A treatment of this kind is described in British Patent GB 548 880 (Magnesium Metal Corporation Limited). for example.

This type of flux reduces the calcium content in accordance with the reaction:

$$MgCl_2+Ca=CaCl_2+Mg.$$

flux with a titanium tetrachloride, TiCl4, base. A treatment of this kind is described in French Patent FR 1 110 998 (The Dow Chemical Company).

This type of flux permits a reduction in the silicon content.

flux with a boron trichloride BC13 base. A treatment of this kind is described in French Patent FR 2 516 940. (Sofrem).

Combined with an initial treatment with TiCl4, this type of flux permits a considerable reduction in the silicon contents by precipitating the intermetallic compounds.

The calcium chloride and the various intermetallic compounds formed during these reactions with the flux are all heavier than the liquid magnesium, and tend to decant at the bottom of the recipient. These treatments by fluxes are therefore followed by a decantation period for the heavier products formed to be separated.

These fluxes treatments, when combined, permit a reduction in the calcium content, initially between 0.3% and 1.5%, to a final content of less than 0.003%, and in the silicon content, initially between 0.15 and 0.4%, to 0.01–0.08%.

The metal is then pumped from the upper part of the bath.

The bottom part of the recipient which contains the decanted impurities is obviously not pumped out, and thus a variable amount of magnesium is left at the bottom depending on the duration of the decantation operation and the amount of separated impurities.

Austrian Patent 139 432 (Oesterreichisch Amerikanische Magnesit A. G.) proposes a treatment for the recovery and purification of magnesium waste consisting in remelting the magnesium to be purified in the presence of small added quantities of salts or salt mixtures, such as chlorides or sulphides, of heavy metals which form little or no alloys with the magnesium, or which form an alloy which has no adverse effect on the properties of the magnesium. The salts cited by way of example are ferric chloride, manganese chloride, antimony trifluorides and trisulphides, cadmium boride, copper chloride and zinc chloride. Magnesium halogenides can be added to them. The melting point of these salts or mixtures of salts must be less than that of the magnesium; their density must be greater than that of the molten magnesium. The treatment described permits oxides, nitrides, carbides, silicides and carbon to be removed.

German Patent 1 031 975 (Knapsack-Griesheim A. G.) describes a process for refining the structure and for improving the mechanical properties of the magnesium and its alloys. The process consists in adding to the metal which has already been purified and brought to a temperature <800° C. compounds of iron-sulphur or iron-phosphorus, in distributing them uniformly, in bringing the metal to the casting temperature and in casting the metal. This treatment replaces an old process for refining the grain which simply consisted in keeping the magnesium bath at a temperature of between 850°and 900° C. for at least 10 mins before cooling for the casting process.

These two latter patents do not disclose means for reducing the calcium and silicon contents. The first patent only describes a washing process intended to collect non metallic inclusions such as oxides, nitrides, carbides, silicides, carbon. The second patent does not describe a process for washing the metal since the metal must be purified initially, but this second patent describes a metallurgical treatment intended to refine the grain of cas products and thus intended to improve the mechanical properties.

PROBLEM POSED

The treatment to the chlorides, however effective it is, has certain drawbacks. Firstly, it can make several successive operations necessary with $MgCl_2$, $TiCl_4$ and $BCl_3$ which are quite expensive reagents. Also, $MgCl_2$ is not very suitable for use because it is greatly hygroscopic. It can be necessary to keep it at the surface of the magnesium for a certain length of time in order to dry it. This brings about oxidation of the metal by the water vapour, and thus a loss of metal and the formation of oxide dross and hydrogen which introduces gas into the metal. Last, and not least, chlorides can remain in the magnesium in the form of inclusions which mark the ingots and impair the resistance of the magnesium to corrosion.

The inventors have been working on realising a treatment which does not have the afore-mentioned drawbacks, and which, in particular, avoids the use of chlorides.

OBJECT OF THE INVENTION

The object of the invention is a process for the treatment of liquid magnesium which permits a reduction in calcium and silicon contents. This process consists in contacting the magnesium bath with metallic sulphides, in particular iron sulphides in such a way that the insoluble compounds of calcium and silicon are precipitated, and in such a way that they are grouped together and separated from the metal.

DESCRIPTION OF THE INVENTION

The inventors have found a unique reagent, which, provided that it is used under certain conditions, is capable of significantly reducing both the calcium and silicon contents of the magnesium. This reagent is also easy to use since it is inert to atmospheric agents.

The reagent is a metallic sulphide, preferably an iron sulphide, and, in particular, iron bisulphide $FeS_2$. The inventors have disclosed the original way in which the sulphide acts: the anionic element S combines with the calcium to precipitate the calcium sulphide CaS, whilst the cationic element Fe combines with the silicon to give an intermetallic compound Fe-Si which also precipitates at the treatment temperature. The reactions are as follows:

$$FeS_2+Mg=MgS+Fe$$

$$MgS+Ca=CaS+Mg$$

$$Fe+Si=FeSi.$$

These reactions permit calculation of the amount of iron sulphide needed in accordance with the stoichiometry to precipitate the calcium into the state of calcium sulphide, and the silicon into the state of the intermetallic compound Fe-Si, as a function of the initial calcium and silicon contents of the magnesium.

For a magnesium bath containing 1% Ca, it is theoretically necessary to add 0.8% of sulphur, that is to say 2.2% FeS or 1.5% FeS2.

For a magnesium bath containing 0.3% silicon, it is theoretically necessary to add 0.6% iron, that is to say 0.94% FeS or 1.29% FeS2.

The examples given hereinafter show that with quite large quantities, excellent results are obtained with percentages of sulphur close to the stoichiometry, but in the laboratory this percentage has to be considerably higher.

In practice, the amounts of sulphide to be used vary between 1 and 10% of the weight of the magnesium to be treated. A treatment of this kind allows the initial calcium content of between 0.3% and 1.5% to be brought to a very low final content which can be less than 0.010%, and even in the order of 0.003%.

The silicon content is also reduced, but in smaller proportions: it moves from a value of between 0.15 and 0.4% to a value in the order of 0.05–0.08%.

Sulphides other than iron bisulphide FeS2 can be used: iron sulphide FeS, for example, or molybdenum bisulphide MoS2. Commercially available iron monosulphide has the drawback of containing significant amounts of copper which occur in the magnesium and make it fragile. For this reason, bisulphide is usually preferred.

Molybdenum sulphide is a preferable reagent, in particular for reducing the silicon content of the magnesium. It is possible to reduce this content to 0.04%. However, since it is more expensive than FeS2, it is preferably used not on its own but mixed with iron mono- or bisulphide, or in a second treatment to complete the first treatment with iron mono or bisulphide.

In this latter case, the first treatment removes the majority of the calcium and considerably reduces the silicon content, and the second treatment improves the reduction in silicon content.

The treatment which is the object of the invention is used in the following way:

1) The magnesium to be purified is brought to a temperature of between 700° and 750° C., its upper surface being protected by argon being swept over it, or a mixture of SF6-air-CO2 and/or a layer of flow.
2) The upper part of the bath undergoes stirring either by the use of a mechanical agitator or by insufflation of an inert gas such as argon.
3) In one single step or by successive fractions, iron sulphide which may, or may not, be mixed with molybdenum bisulphide, or for the last fraction, pure molybdenum bisulphide coarsely crushed to a size of less than 2 mm, is added either into the vortex created by mechanical agitation or using a lance, in suspension, into the insufflated inert gas.

It is very important that the sulphide is crushed and that the amounts of sulphides are added with vigorous agitation, since, unlike certain prior art processes, the reagent remains solid at the temperatures at which the treatment is carried out. It is neither melted nor diluted in a molten salt.
4) After each addition, the bath is agitated for at least 5 minutes, and is followed by decantation without agitation for a period of at least 10 minutes.
5) After the last addition, the bath is decanted for at least 1 hour.

These decantation operations are also very important since the insoluble compounds Fe-Si and CaS are precipitated from the Si and Ca elements dissolved in the liquid metal bath. They are therefore very fine at the start and they must be given time to coalesce and decant.
6) The metal is pumped from the upper surface; preferably, arranged over the intake means of the pump is a filtering bed constituted, for example, of white corundum or any divided refractory substance.

EXAMPLE 1

In a crucible, 11.6 kg crude magnesium coming from the reduction of magnesium ore by the use of iron-silicon is brought to 730° C. To avoid oxidation, the crucible is placed in an atmosphere of argon, and the free surface of the metal is protected by a cover flux. An agitation means, arranged in the metal bath in such a way that the bottom of the crucible is not agitated, is set in motion at a speed of 125 revs/min. 400 g iron monosulphide FeS with grains of 0 to 2 mm in size is then introduced into the bath, and agitated for 10 minutes. After this, the metal is allowed to decant for 15 minutes, and a first sample is taken from the upper part of the bath. The agitation means is then set in motion again, and a second addition is made of 400 g iron monosulphide, followed by agitation for 10 minutes. The metal is then allowed to decant again for 15 mins, and a second sample is taken from the upper part of the bath. The agitation means is then once again set in motion, and a third addition is made, this time 250 g molybdenum bisulphide MoS2, followed by agitation for 10 minutes. The metal is once again allowed to decant for 15 minutes, and a third sample is taken from the upper part of the bath. Decantation is continued for another hour, and a fourth sample is then taken, still from the upper part of the bath. The additions of sulphides are summarised in the following table:

| Addition | Weight | % Mg | accumulated weight | accumulated % |
|---|---|---|---|---|
| FeS | 400 g | 3.45% | 400 g | 3.45% |
| FeS | 400 g | 3.45% | 800 g | 6.9% |
| MoS2 | 250 g | 2.16% | 250 g | 2.16% |

The following table shows the development of calcium and silicon contents of the magnesium. (in parts per million)

| | Ca | Si |
|---|---|---|
| Initial content | 11650 | 2400 |
| Sample 1 | 6400 | 2400 |
| Sample 2 | 555 | 2000 |
| Sample 3 | 123.5 | 655 |
| Sample 4 | 86.5 | 925 |

The table shows the excellent results obtained using successive treatments with iron monosulphide and molybdenum bisulphide: in comparison with the initial contents, Sample 1 has lost 45% calcium Sample 2 has lost 95% calcium and 17% silicon Sample 3 has lost 99% calcium and 73% silicon.

Sample 4 has lost 99.3% calcium and 61.5% silicon.

Clearly, the slight increase in silicon content in Sample 4 compared with Sample 3 is not of great significance. It is very important to note the noticeable efficiency of MoS2 on the silicon content which moves, after this treatment, to 38.5% of its initial content.

EXAMPLE 2

In a crucible, 10.7 kg crude magnesium coming from the reduction of magnesium ore using iron-silicon is brought to 730° C. To avoid oxidation, the crucible is placed in an atmosphere of argon, and the free surface of the metal is protected by a cover flux. An agitating means, arranged in the metal bath in such a way that the bottom of the crucible is not agitated, is set in motion at a speed of 125 revs/min. 400 g iron monosulphide FeS with grains of 0 to 2 mm in size is then introduced into the bath, and then agitated for 10 minutes. After this, the metal is left to decant for 15 minutes, and a first sample is taken from the upper part of the bath. The agitation means is then set in motion, and a second addition is made of 240 g molybdenum bisulphide MoS2, and then agitated for 10 minutes. Then, the metal is once again decanted for 15 minutes, and a second sample is taken from the upper part of the bath. The decantation operation continues for one hour, and a third sample is then finally taken, still from the upper part of the bath. The additions of sulphides are summarised in the following table:

| Addition | weight | % Mg |
|---|---|---|
| FeS | 400 g | 3.74% |
| MoS2 | 240 g | 2.24% |

The following table shows the development of the calcium and silicon contents. (in parts per million)

| | Ca | Si |
|---|---|---|
| Initial content | 10900 | 2050 |
| Sample 1 | 5450 | 2500 |
| Sample 2 | 325 | 375 |
| Sample 3 | 385 | 395 |

This table shows the excellent results obtained using successive treatments with iron monosulphide and molybdenum bisulphide: in comparison with initial contents, Sample 1 has lost 50% calcium Sample 2 has lost 97% calcium and 82% silicon Sample 3 has lost 96% calcium and 81% silicon.

Very slight increases in the calcium and silicon contents of Sample 3 compared with Sample 2 are insignificant. The efficiency of MoS2 on the content of silicon is even more noticeable than in the previous example since the content is reduced, after the treatment, to 18% of its initial content.

EXAMPLE 3

This example is concerned with an industrial test on the condenser in which the magnesium from the reduction of magnesium ore has been collected. The condenser contains 13,150 kg of magnesium to be purified. This metal is brought to 730° C. and maintained at that temperature for the entire duration of the operation. To avoid oxidation, the free surface of the metal is protected by a cover flux. An agitation means, disposed in the metal bath in such a way that the bottom of the crucible is not agitated, is set in motion at a speed of 125 revs/min. Iron bisulphide FeS2 with grains of between 0 and 2 mm in size is then introduced into the bath in 4 successive additions:

| No. of addition | weight | % Mg | accumulated weight | % accumulated |
|---|---|---|---|---|
| 1 | 100 kg | 0.74% | 100 kg | 0.74% |
| 2 | 50 kg | 0.37% | 150 kg | 1.11% |
| 3 | 50 kg | 0.37% | 200 kg | 1.48% |
| 4 | 40 kg | 0.3% | 240 kg | 1.78% |

After each addition, the agitating means is allowed to operate for 30 minutes. After this, the metal is allowed to decant for 30 mins in the case of the first three additions, and for 120 minutes after the last addition, and a sample is taken from the upper surface of the bath. Four reference samples are thus taken, in the order 1, 2, 3, 4. The metal is then pumped from the upper part of the bath through a filtering bed constituted of particles of white corundum. Six samples are taken at regular intervals during the casting operation, each sample representing the mean composition of successive layers of the crucible from the top to the bottom. (samples numbered 11 to 16).

The following table shows the development of calcium and silicon contents of the magnesium. (in parts per million)

| | Ca | Si |
|---|---|---|
| Initial content | 16430 | 3680 |
| Sample 1 | 10980 | 3480 |
| Sample 2 | 3740 | 2310 |
| Sample 3 | 290 | 1230 |
| Sample 4 | 80 | 1050 |
| Sample 11 | 25 | 770 |
| Sample 12 | 25 | 780 |
| Sample 13 | 50 | 760 |
| Sample 14 | 30 | 770 |
| Sample 15 | 30 | 750 |
| Sample 16 | 55 | 780 |

This table shows:

that in the first fractions drawn off by pumping, representing roughly 50% of the volume of the bath, it is possible to obtain a very low residual content of calcium, between 25 and 50 parts per million, and a low residual content of silicon of between 750 and 780 parts per million, corresponding to an increased amount of purified silicon of 79%.

that the decanting operation plays an important part as shown by the reduction in contents of Ca and Si in the first fractions cast compared with the metal removed after the first addition: it is certainly possible to improve the purification rates and the quantities purified by increasing the duration of the decantation operation.

What is claimed is:

1. A process for treating liquid magnesium to remove dissolved calcium and silicon therefrom, comprising the steps of:

adding to the liquid magnesium a divided metallic sulphide selected from the group consisting of iron and molybdenum sulphides, and agitating to improve contact between the liquid magnesium and sulphide, said adding causing the precipitation of calcium sulphide and intermetallic compounds containing silicon and iron or molybdenum; and separating the calcium sulphide and intermetallic compounds from the liquid magnesium by decanting.

2. A process according to claim 1, additionally comprising repeating said steps at least once, wherein the agitation is performed to affect only an upper part of the liquid magnesium.

3. A process claim 1 or 2, wherein the sulphide is iron, monosulphide or bisulphide.

4. A process according to claim 1 or 2, sulphide is molybdenum bisulphide.

5. A process according to claim 2, wherein in a first series of steps the sulphide is an iron sulphide, and, in a subsequent series of steps, the sulphide is molybdenum bisulphide.

6. A process according to claim 1 or 2, wherein the agitating is carried out by insufflation of an inert gas, and the sulphide is introduced in a suspension of the inert gas using a lance.

7. A process according to claim 1 or 2, wherein the total amount of sulphide used is between 1 and 10% of the weight of the magnesium.

* * * * *